US010151466B2

(12) United States Patent
Sonneman

(10) Patent No.: US 10,151,466 B2
(45) Date of Patent: Dec. 11, 2018

(54) LATERALLY SUPPORTED LIGHTS

(71) Applicant: Contemporary Visions, LLC, Larchmont, NY (US)

(72) Inventor: Robert A. Sonneman, Mamaroneck, NY (US)

(73) Assignee: CONTEMPORARY VISIONS, LLC, Larchmont, NY (US)

( * ) Notice: Subject to any disclaimer, the term of this patent is extended or adjusted under 35 U.S.C. 154(b) by 0 days.

(21) Appl. No.: 15/427,217

(22) Filed: Feb. 8, 2017

(65) Prior Publication Data

US 2018/0128465 A1 May 10, 2018

Related U.S. Application Data

(63) Continuation-in-part of application No. 29/584,479, filed on Nov. 15, 2016, now Pat. No. Des. 788,343.
(Continued)

(51) Int. Cl.

| | |
|---|---|
| ***F21V 3/00*** | (2015.01) |
| ***F21V 21/35*** | (2006.01) |
| ***F21S 2/00*** | (2016.01) |
| ***F21S 8/06*** | (2006.01) |
| ***F21V 21/104*** | (2006.01) |
| ***F21V 23/02*** | (2006.01) |
| ***F21V 23/06*** | (2006.01) |
| ***F21V 21/08*** | (2006.01) |
| *F21V 21/002* | (2006.01) |
| *F21Y 105/10* | (2016.01) |
| *F21Y 115/10* | (2016.01) |

(52) U.S. Cl.
CPC ..... *F21V 21/35* (2013.01); *F21S 2/005* (2013.01); *F21S 8/061* (2013.01); *F21S 8/063* (2013.01); *F21S 8/066* (2013.01); *F21V 21/08* (2013.01); *F21V 21/104* (2013.01); *F21V 23/02* (2013.01); *F21V 23/06* (2013.01); *F21V 21/002* (2013.01); *F21Y 2105/10* (2016.08); *F21Y 2115/10* (2016.08)

(58) Field of Classification Search
CPC ..... F21V 21/35; F21V 21/104; F21V 23/02; F21V 23/06; F21S 2/005; F21S 8/061; F21S 8/063
USPC ..... 362/311.01, 311.06
See application file for complete search history.

(56) References Cited

U.S. PATENT DOCUMENTS

| | | | |
|---|---|---|---|
| 2,292,395 | A | 8/1942 | O'Brien |
| D217,785 | S | 6/1970 | Wolff |

(Continued)

FOREIGN PATENT DOCUMENTS

| | | | |
|---|---|---|---|
| CN | 200 986 123 | Y | 12/2007 |
| CN | 205261379 | U | 5/2016 |

(Continued)

OTHER PUBLICATIONS

USPTO, Non-Final Office Action dated Jan. 13, 2017 issued in corresponding U.S. Appl. No. 15/251,369.

(Continued)

*Primary Examiner* — Anh Mai
*Assistant Examiner* — Meghan Ulanday
(74) *Attorney, Agent, or Firm* — Gottlieb, Rackman & Reisman, P.C.

(57) ABSTRACT

A light or pendant is selectively mountable at any point on two rods. The light includes a body with a light source and two wings creating respective interference fits with the rods to support the light and to provide power from the rods to the light source.

18 Claims, 20 Drawing Sheets

Related U.S. Application Data

(60) Provisional application No. 62/419,505, filed on Nov. 9, 2016.

(56) References Cited

U.S. PATENT DOCUMENTS

| | | | |
|---|---|---|---|
| D222,748 | S | 12/1971 | Strianese |
| 3,716,031 | A | 2/1973 | Rowbury |
| 3,748,463 | A | 7/1973 | Trassinelli |
| 4,723,747 | A | 2/1988 | Karp |
| 4,758,935 | A | 7/1988 | Frassati et al. |
| 4,763,870 | A | 8/1988 | Wodlinger |
| D301,304 | S | 5/1989 | Will |
| D317,058 | S | 5/1991 | Sonneman |
| 5,025,355 | A | 6/1991 | Harwood |
| D320,465 | S | 10/1991 | Sonneman |
| 5,065,295 | A | 11/1991 | De La Haye et al. |
| 5,105,349 | A | 4/1992 | Falls |
| D360,046 | S | 7/1995 | Sugiura |
| 5,440,469 | A | 8/1995 | Gomes |
| 5,455,754 | A | 10/1995 | Hoffner |
| 5,584,576 | A | 12/1996 | Hong |
| D392,407 | S | 3/1998 | Johnson et al. |
| 5,833,358 | A | 11/1998 | Patik |
| 6,135,615 | A | 10/2000 | Lee |
| 6,179,442 | B1 | 1/2001 | Schurle |
| 6,241,369 | B1 | 6/2001 | Mackiewicz |
| 6,244,733 | B1 | 6/2001 | Fong et al. |
| 6,341,979 | B1 | 1/2002 | Yamamoto |
| 6,409,524 | B1 | 6/2002 | Miller et al. |
| 6,489,748 | B1 | 12/2002 | Okamura |
| 6,659,623 | B2 | 12/2003 | Friend |
| 6,769,790 | B2 | 8/2004 | Fruhm |
| D507,374 | S | 7/2005 | Chen |
| 7,172,332 | B2 | 2/2007 | Mobarak et al. |
| 7,246,935 | B2 | 7/2007 | Benghozi et al. |
| 7,397,384 | B1 | 7/2008 | MacKenzie, IV |
| 7,503,778 | B2 | 3/2009 | Lehman et al. |
| 7,507,005 | B1 | 3/2009 | Mier-Langner |
| 7,520,762 | B2 | 4/2009 | Lehman et al. |
| 7,520,763 | B1 | 4/2009 | Buse |
| 7,527,406 | B2 | 5/2009 | Kwon |
| D595,884 | S | 7/2009 | Liao |
| 7,563,000 | B2 | 7/2009 | Gierveld |
| 7,571,736 | B1 | 8/2009 | Chu |
| 7,654,834 | B1 | 2/2010 | Imier-Langner et al. |
| D611,169 | S | 3/2010 | Harder |
| D620,168 | S | 7/2010 | Sabernig |
| 7,798,824 | B2 | 9/2010 | Fong |
| 7,806,913 | B2 | 10/2010 | Fanger |
| D629,954 | S | 12/2010 | Compton |
| D632,423 | S | 2/2011 | Canfield |
| 7,955,125 | B1 | 6/2011 | Petrillo |
| D648,470 | S | 11/2011 | Rains |
| D649,692 | S | 11/2011 | Trzesniowski |
| 8,061,865 | B2 | 11/2011 | Piepgras et al. |
| D671,670 | S | 11/2012 | Sonneman |
| 8,398,276 | B2 | 3/2013 | Pearson et al. |
| D680,673 | S | 4/2013 | Levine |
| D689,221 | S | 9/2013 | Isaac |
| 8,523,378 | B2 | 9/2013 | Schulzman |
| 8,584,412 | B2 | 11/2013 | Frecska et al. |
| 8,616,871 | B2 | 12/2013 | Galomb |
| 8,733,710 | B1 | 5/2014 | Suazo |
| 8,794,804 | B2 | 8/2014 | Verfuerth |
| 8,814,383 | B2 | 8/2014 | Bizzotto et al. |
| 8,840,319 | B2 | 9/2014 | Hogue |
| 8,967,573 | B2 | 3/2015 | Hemmer |
| D739,070 | S | 9/2015 | Wilson |
| 9,136,659 | B2 | 9/2015 | Fishman et al. |
| D747,636 | S | 1/2016 | Maher |
| 9,387,268 | B2 | 7/2016 | Farren |
| D765,296 | S | 8/2016 | Wei |
| 9,464,772 | B2 | 10/2016 | O'Brien et al. |
| 9,472,912 | B2 | 10/2016 | Schirmeier |
| D772,467 | S | 11/2016 | Sonneman |
| D772,475 | S | 11/2016 | Sonneman |
| D773,099 | S | 11/2016 | Sonneman |
| D773,101 | S | 11/2016 | Sonneman |
| D773,715 | S | 12/2016 | Sonneman |
| D773,719 | S | 12/2016 | Sonneman |
| D773,725 | S | 12/2016 | Sonneman |
| D775,397 | S | 12/2016 | Sonneman |
| D779,113 | S | 2/2017 | Sonneman |
| D779,437 | S | 2/2017 | Sonneman |
| D779,712 | S | 2/2017 | Sonneman |
| D779,713 | S | 2/2017 | Sonneman |
| D779,714 | S | 2/2017 | Sonneman |
| D779,715 | S | 2/2017 | Sonneman |
| D782,990 | S | 4/2017 | Sonneman |
| 9,739,460 | B2 | 8/2017 | Haubach |
| 9,765,954 | B2 | 9/2017 | Zaderej et al. |
| 2003/0031018 | A1 | 2/2003 | Bray et al. |
| 2003/0103347 | A1 | 6/2003 | Friend |
| 2004/0005798 | A1 | 1/2004 | Lin |
| 2004/0160767 | A1 | 8/2004 | Mobarak et al. |
| 2005/0207173 | A1 | 9/2005 | Benghozi |
| 2007/0053209 | A1 | 3/2007 | Uhler et al. |
| 2007/0115694 | A1 | 5/2007 | Mobarak et al. |
| 2007/0247845 | A1 | 10/2007 | Udo |
| 2008/0190043 | A1 | 8/2008 | Beckmann |
| 2009/0051292 | A1 | 2/2009 | Noh |
| 2009/0123994 | A1 | 5/2009 | Lafaye et al. |
| 2010/0271834 | A1 | 10/2010 | Muessli |
| 2010/0271847 | A1 | 10/2010 | Mobarak et al. |
| 2012/0257388 | A1 | 10/2012 | Bracher et al. |
| 2014/0226315 | A1 | 8/2014 | Nicieja et al. |
| 2015/0198311 | A1 | 7/2015 | O'Brien et al. |
| 2015/0316238 | A1 | 11/2015 | Guilmette |
| 2015/0338037 | A1 | 11/2015 | Wang et al. |
| 2016/0033098 | A1 | 2/2016 | Bergman et al. |
| 2017/0198892 | A1 | 7/2017 | Sonneman |

FOREIGN PATENT DOCUMENTS

| | | | |
|---|---|---|---|
| DE | 8708815 | U1 | 11/1987 |
| DE | 1414046 | A1 | 10/1995 |
| DE | 29705852 | U1 | 5/1997 |
| DE | 19849101 | A1 | 4/1999 |
| DE | 202004001178 | U1 | 5/2004 |
| EP | 0320661 | A2 | 6/1989 |
| EP | 0379244 | A1 | 7/1990 |
| EP | 0734108 | A2 | 9/1996 |
| EP | 1757858 | A2 | 2/2007 |
| EP | 1847763 | A1 | 10/2007 |
| EP | 2821695 | A1 | 1/2015 |
| EP | 3196547 | A1 | 7/2017 |
| FR | 608 016 | A | 7/1926 |
| FR | 2588713 | A1 | 4/1987 |
| WO | 2016/132361 | A1 | 8/2016 |
| WO | 2016/150564 | A2 | 9/2016 |

OTHER PUBLICATIONS

USPTO, Non-Office Action dated Mar. 3, 2017 issued in corresponding U.S. Appl. No. 15/255,289.

USPTO, Non-Final Office Action dated Mar. 7, 2017 issued in corresponding U.S. Appl. No. 15/287,897.

USPTO, Non-Final Office Action dated Feb. 10, 2017 issued in corresponding U.S. Appl. No. 15/286,977.

USPTO, Non-Final Office Action dated Mar. 1, 2017 issued in corresponding U.S. Appl. No. 15/378,207.

USPTO, Non-Final Office Action dated Dec. 22, 2016 issued in corresponding U.S. Appl. No. 15/197,919.

USPTO, Final Office Action dated Apr. 5, 2017 issued in corresponding U.S. Appl. No. 15/197,919.

EPO, Extended European Search Report dated Jun. 26, 2017 issued in corresponding European Patent Application No. 171506868.8.

USPTO, Non-Final Office Action dated Aug. 18, 2017 issued in corresponding U.S. Appl. No. 15/584,171.

USPTO, Non-Final Office Action dated Sep. 27, 2017 issued in corresponding U.S. Appl. No. 15/407,085.

(56) References Cited

OTHER PUBLICATIONS

USPTO, Final Office Action dated Jun. 6, 2017 issued in corresponding U.S. Appl. No. 15/251,369.
USPTO, Non-Final Office Action dated Sep. 7, 2017 issued in corresponding U.S. Appl. No. 15/287,897.
Non-Final Office Action dated Dec. 6, 2017 issued in corresponding U.S. Appl. No. 15/446,302.
Non-Final Office Action dated Dec. 22, 2017 issued in corresponding U.S. Appl. No. 15/584,171.
Final Office Action dated Dec. 29, 2017 issued in corresponding U.S. Appl. No. 15/287,897.
Non-Final Office Action dated Jan. 12, 2018 issued in corresponding U.S. Appl. No. 15/801,855.
Non-Final Office Action dated Jan. 11, 2018 issued in corresponding U.S. Appl. No. 15/801,893.
Non-Final Office Action dated Jan. 11, 2018 issued in corresponding U.S. Appl. No. 15/808,109.
EPO, Extended European Search Report dated Jan. 3, 2018 issued in corresponding European Patent Application No. 17200563.9.
EPO, Extended European Search Report dated Jan. 5, 2018 issued in corresponding European Patent Application No. 17200550.6.
EPO, Extended European Search Report dated Mar. 27, 2018 issued in corresponding European Patent Application No. 17200553.0 filed Nov. 8, 2017.
EPO, Extended European Search Report dated Mar. 28, 2018 issued in corresponding European Patent Application No. 17200535.7 filed Nov. 8, 2017.
EPO, Extended European Search Report dated Mar. 28, 2018 issued in corresponding European Patent Application No. 17200541.5 filed Nov. 8, 2017.
EPO, Partial European Search Report dated Apr. 24, 2018 issued in corresponding European Patent Application No. 17200544.9 filed Nov. 8, 2017.
EPO, Extended European Search Report dated Aug. 7, 2018 issued in corresponding European Patent Application No. 17200544.9 filed Nov. 8, 2017.
CIPO, First Office Action dated Sep. 25, 2018 issued in corresponding Canadian Patent Application No. 2,984,651 filed Nov. 2, 2017.
CIPO, First Office Action dated Sep. 25, 2018 issued in corresponding Canadian Patent Application No. 2,984,672 filed Nov. 2, 2017.

LATERALLY SUPPORTED LIGHTS

CROSS-REFERENCE TO RELATED APPLICATION

This application claims the benefit under 35 U.S.C. § 119 to U.S. Provisional Patent Application No. 62/419,505, filed Nov. 9, 2016, and U.S. Design patent application Ser. No. 29/584,479, filed Nov. 15, 2016, which are hereby incorporated by reference in their entirety as part of the present disclosure.

FIELD OF THE INVENTION

This invention relates to a light fixture and more specifically to a light that includes body that has two opposed sides arranged for mounting a hanger with two vertical conductors that engage and support the body along the opposed sides. The light is particularly useful in a modular lighting system that has components that can be assembled to form multi-level light fixtures of various sizes, shapes and configurations. The main elements of a modular lighting system are canopies, hangers, power bars, and pendants, preferably including LED bulbs. The laterally supported lights can be one of the pendants of the modular system.

BACKGROUND OF THE INVENTION

Designing lighting for a space has always been a challenge because the lighting equipment has to meet utilitarian, technical and aesthetic needs. Thus, any such endeavor is successful only if technical, architectural and artistic skills are combined.

Several different types of ceiling lights are presently available, including surface mounted lights, recessed lights and hanging lights. The present invention pertains to hanging lights.

SUMMARY OF THE INVENTION

The present invention is directed to a modular lighting system that includes canopies, which are connectable to a power source, a plurality of power bars, a plurality of hangers, including a first set of hangers that support the power bars from the canopy and a second set of hangers and a plurality of lights or pendants supported by the hangers. The hangers and power bars cooperate to provide electric power to the lights or pendants from the canopy.

Each power bar can include two bar segments that face each other and are made of a non-conductive material. Conductive rails are provided on the inner surface of each of the bar segments. The base of each of the hangers is configured to form an interference fit with the segments of the power bar, and the hangers include two conductive parallel rods or cables that are in electrical contact with the rails of the segments of the power bars through the respective bases.

These various elements are combined in many different ways resulting in a virtually infinite number of configurations. One configuration may include several power bars disposed in a vertical plane. In another configuration, several power bars can extend at different angles in one plane and are joined at a common point. Another configuration may include a combination of the two configurations previously described. Another configuration may include several power bars disposed at different heights or tiers with some of the power bars arranged perpendicular to other power bars.

The light or pendant of the above-described system is configured to be selectively mounted on a hanger at any point along the length of the rods that extend parallel to each other of a hanger. The light includes a body that has at least one surface that supports a light source and a first and a second wing that are sized and shaped for selective attachment at any point along a length of the rods. Each of the first and second wings engage a respective one of the two parallel rods. The light source is powered by current passing through the rods.

In an embodiment, the first and second wings are configured to support the body on the rods and to provide electrical connection between the light source and the rods.

In an embodiment, the light includes a cover that is made of a light transmissive material and covers the light source.

In an embodiment, the body has two opposed surfaces that each include a light source disposed thereon.

In an embodiment, the wings are formed with longitudinal cavities that are shaped to receive the rods and selectively form interference fits with the rods.

In an embodiment, a light is selectively mountable on a first and a second rod of a hanger where each rod has a rod core covered by a layer of insulation. The light includes a body that has at least one surface with a light source and a cover disposed over the light source. The cover is made of a light transmissive material to allow light from the light source to exit. The second wings are attached to and extend from the body. Each wing is configured to selectively engage one of the rods to support the body on the rods and the wings are further adapted to pierce the layers of insulation and provide electrical connection from the rod cores to the light source.

Preferably, the wings are formed with longitudinal cavities that are shaped and sized to selectively form an interference fit with the rods.

In an embodiment, knives are disposed in the cavities of the first and second wings, respectively, to pierce the layers of insulation.

The rods may extend vertically in parallel to each other and the body is attached at any point along a length of the rods.

DETAILED DESCRIPTION OF EMBODIMENTS OF THE INVENTION

With reference now to the drawings, and in particular to FIGS. 1 through 6J, embodiments of modular lighting systems and elements thereof of the present invention will be described.

In general, each modular lighting system of the present disclosure includes one or more canopies, a plurality of hangers, a plurality of power bars and a plurality of lights or pendants. In addition, some systems may also include connectors.

Unless otherwise noted, all of the hangers and all of the power bars described herein and illustrated in the figures include two interconnected elements.

Figure 1:
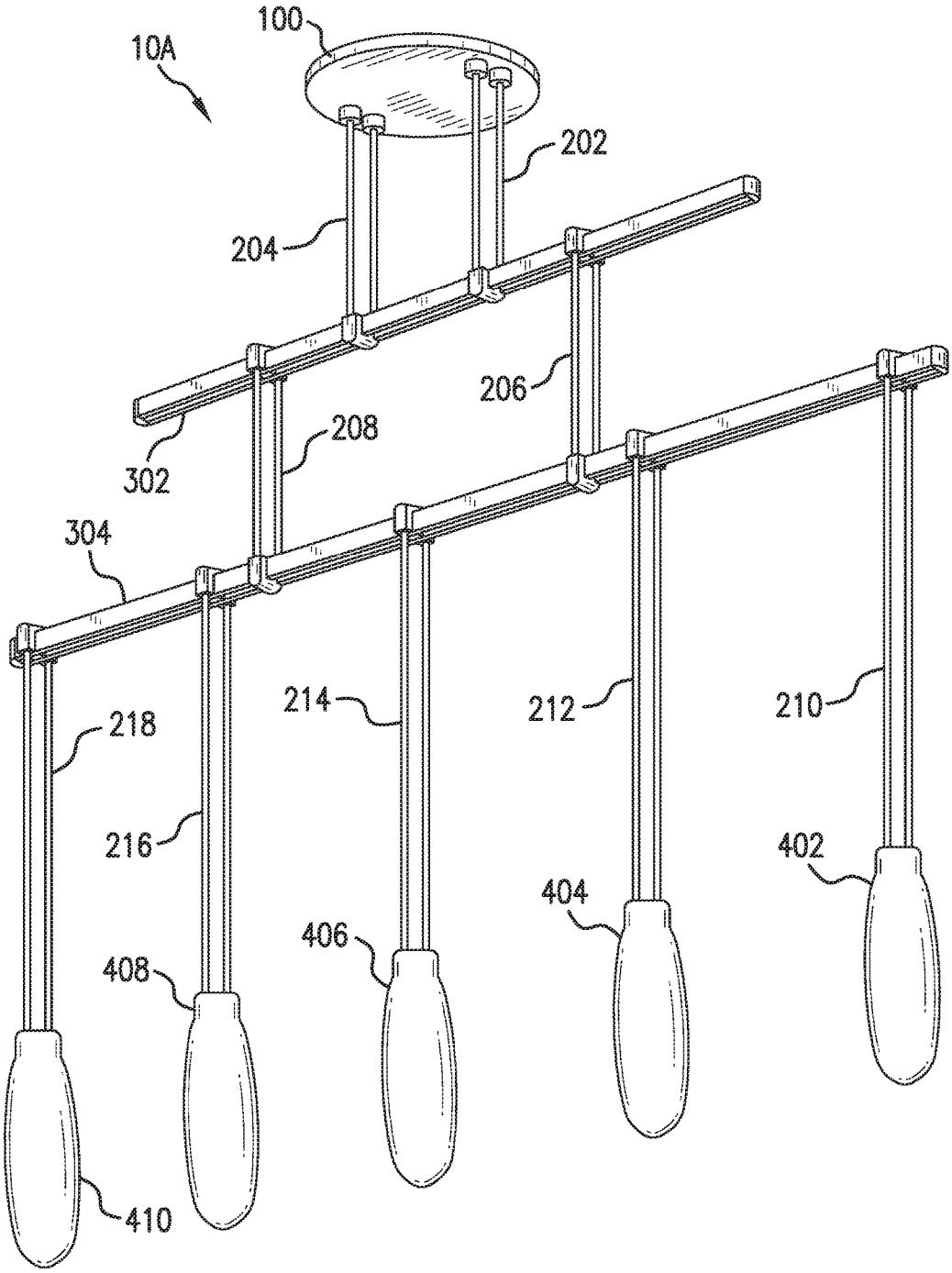
FIG. 1 is a perspective view of an embodiment of a modular lighting system.

FIG. 1 shows an embodiment of a modular lighting system 10A that includes a canopy 100 that supports the modular lighting system 10A from a ceiling or another similar architectural member in a conventional manner. In this case, the canopy 100 also provides power to the modular lighting system 10A. Other, more complicated lighting systems may have several canopies that support such systems and only some or only one canopy may provide power. Here, the canopy 100 includes a conventional power supply that is connected to standard AC lines that provide power to LED in each of the pendants 402, 404, 406, 408, 410 as discussed below. The power supply is hidden.

Two power feed hangers 202, 204 extend downwardly from the canopy 100. In an embodiment, each hanger discussed hereinafter includes two solid bars or rods. In another embodiment, the power feed hangers 202, 204 are replaced by multi-strand twisted steel cables.

Pendant hangers 210, 212, 214, 216, 218 are used to support a plurality of pendants 402, 404, 406, 408, 410, respectively. The pendants 402, 404, 406, 408, 410 preferably include LED bulbs that run on 24 VAC.

Preferably, one of the power feed hangers 202, 204, which includes two hanger segments, is connected to a transformer disposed within the canopy 100. In an embodiment, power from the power feed hanger 202 flows through the first power bar 302, the hanger 206, the second power bar 304 and the hangers 210, 212, 214, 216, 218 to the pendants 402, 404, 406, 408, 410, respectively. The transformer steps down the line voltage from a standard power line to 24 VAC for the pendants 402, 404, 406, 408, 410. The other power feed hanger 204 may be electrically floating. Thus, in this embodiment, all of the power bars 302, 304 carry power. However, only some of the hangers carry power.

Figure 2:
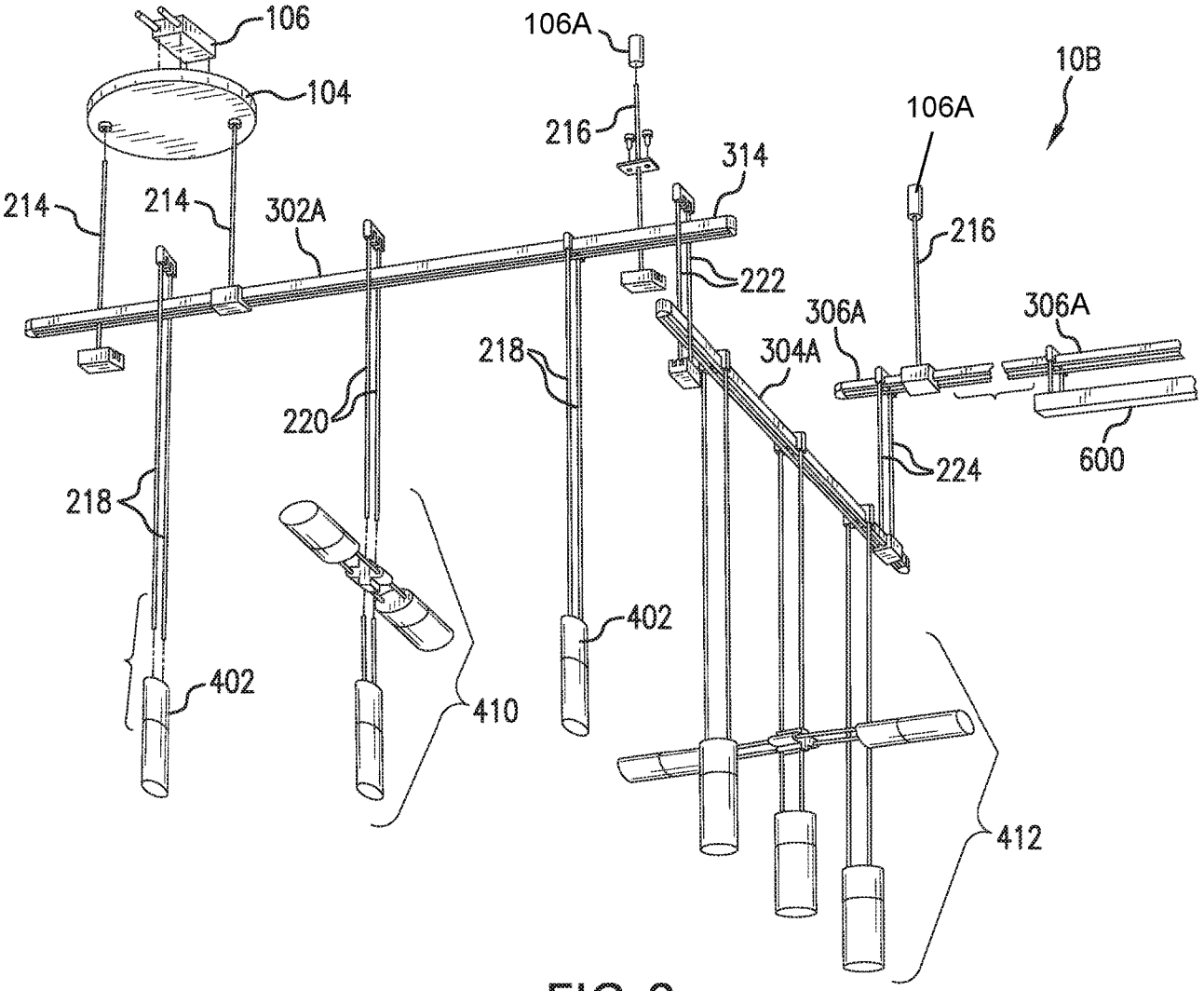
FIG. 2 is a perspective view of another embodiment of modular lighting system.

FIG. 2 illustrates an embodiment of another modular lighting system 10B. This modular lighting system 10B includes a canopy 104 with a transformer 106. Two hangers 214 extend from the canopy 104 and a first bar 302A is secured to the hangers 214. As opposed to the hangers 202, 204, 206, 208, 210, 212, 214, 216, 218 of the modular lighting system 10A of FIG. 1 that include two vertically extending elements, the hangers 214 in FIG. 2 have a single vertically extending element, such as a rod. Each of the hangers 214 provides power to one of the elements of the first power bar 302A. However, because the first power bar 302A is not centered below the canopy 104, but rather extends in one direction away from the canopy 104, another hanger 216, which may be referred to as a ceiling hanger, is used to support a distal end 314 of the first power bar 302. The top end of the ceiling hanger 216 is attached to a sleeve 106A that is secured to the ceiling in a conventional manner.

Hangers 219 are used to attach respective pendants 402 from the first power bar 302A. Another hanger 220 is used to support a cluster of pendants 410.

The modular lighting system 10B includes second power bar 304A that is supported at one end by a hanger 222 and that extends near the distal end of the first power bar 302A. The hanger 222 provides power to the second power bar 304A. A third power bar 306A is supported from the ceiling by ceiling hangers 216 (only one ceiling hanger is shown in FIG. 2 for clarity). The third power bar 306A supports the other end of the second power bar 304A and provides the second power bar 304A with power flowing through a hanger 224 to a plurality of pendants 412. Each of the power bars 302A, 304A, 306A can be used to hang pendants of various sizes and shapes and can be arranged in different configurations as desired.

Figure 3A:
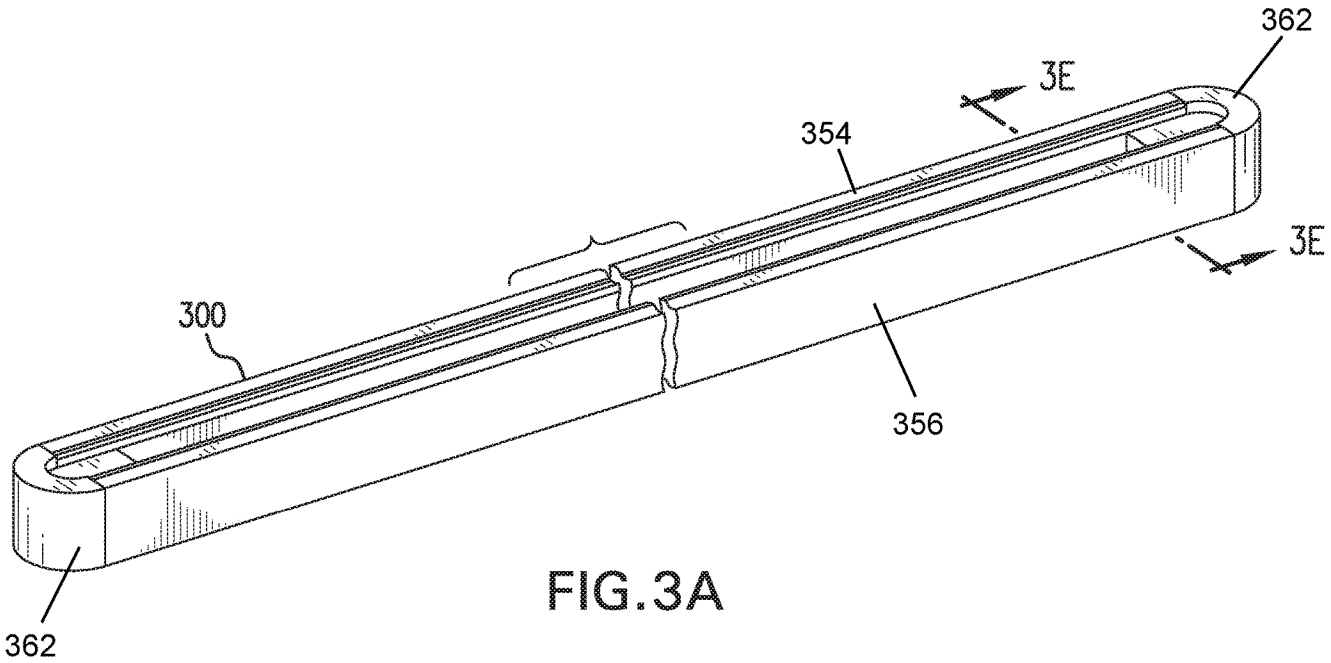
FIGS. 3A-3K are various views showing features of a power bar that can be used in the modular lighting system of FIG. 1 or FIG. 2.
Figure 3B:
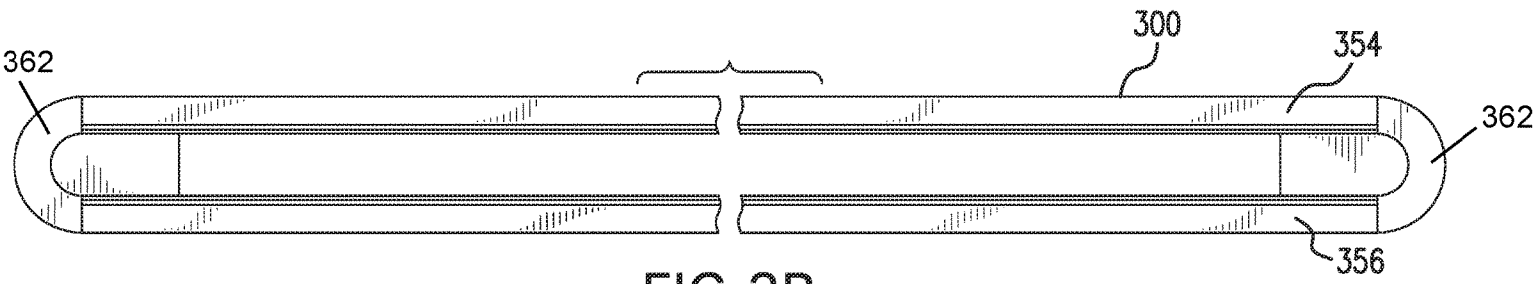
Figure 3C:
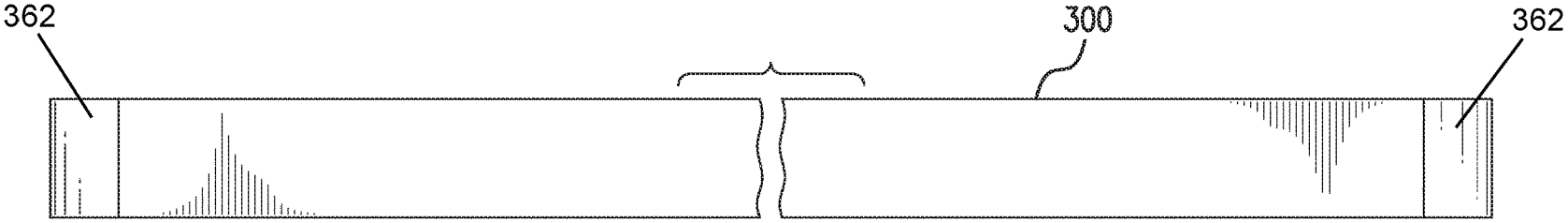
Figure 3E:
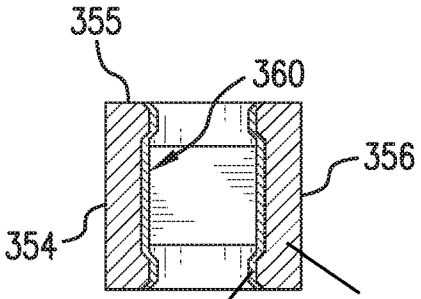
Figure 3D:
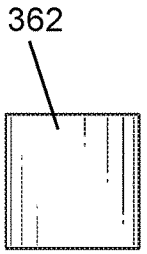
Figure 3F:
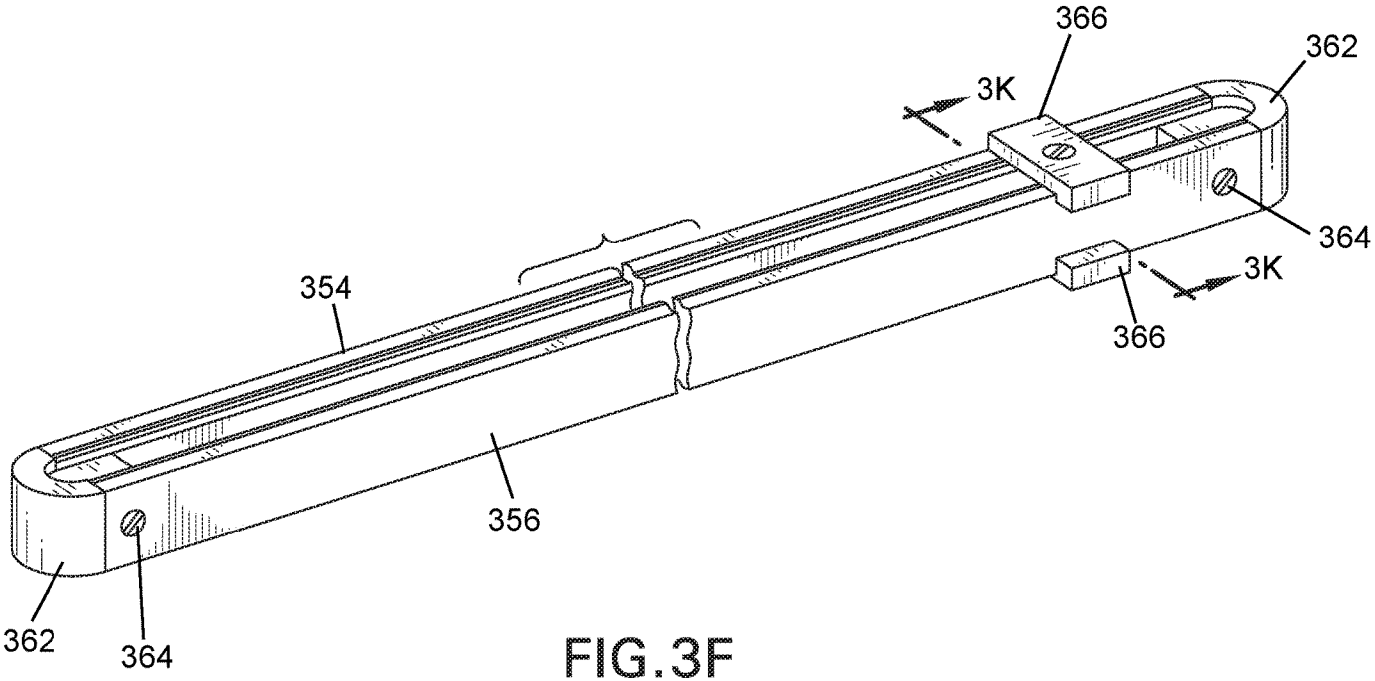
Figure 3G:
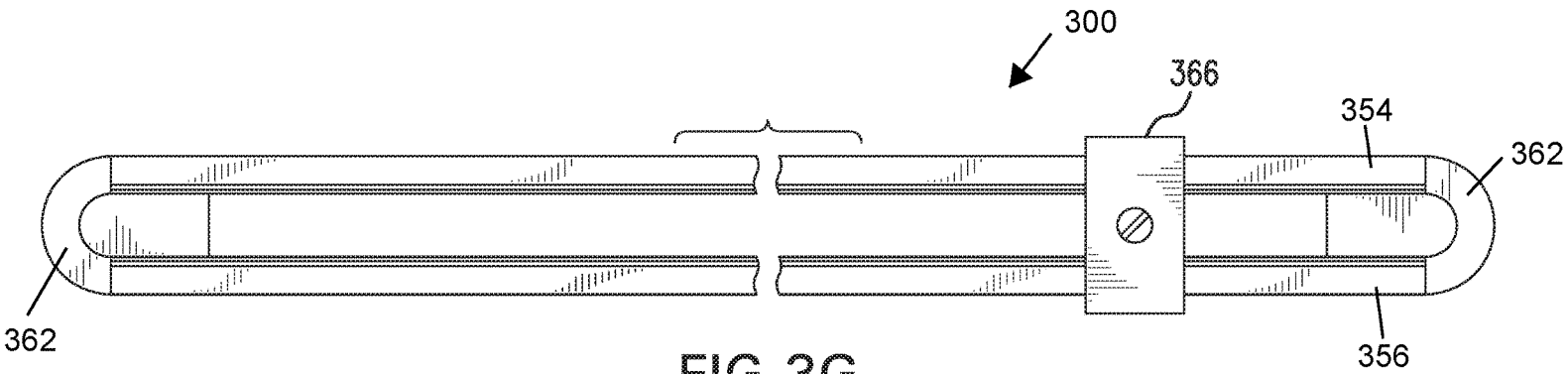

FIGS. 3A-3K show details of embodiments of a generic power bar 300. Unless otherwise noted, all of the power bars discussed previously and subsequently have the same configuration. The power bar 300 is merely a representative power bar of the power bars described herein. In FIGS. 3A-3K, the power bar 300 is shown as being straight. However, the power bar 300 can be circular ellipsoid or another geometric shape. The power bar 300 includes two identical longitudinal segments, or rail, 354, 356 that include inner surfaces that face each other. A cross-sectional view of the power bar 300 is shown in FIG. 3E. Each rail 354, 356 includes a C-shaped main body 355, 357, respectively, made of a non-conductive material, such as a plastic material that is light weight, but strong so that it can support various pendants, other power bars, etc. and channels 360 that are made of a light weight conductive material such as aluminum and are fixed to or are embedded into the inside surface of each rail 354, 356. Preferably, each rail 354, 356, includes a rectangular channel. The rails 354, 356 are joined together at each end by an end connector 362. The connectors 362 are attached to the rails 354, 356 by conventional means, such as screws 364, an adhesive or other means.

Figure 3H:
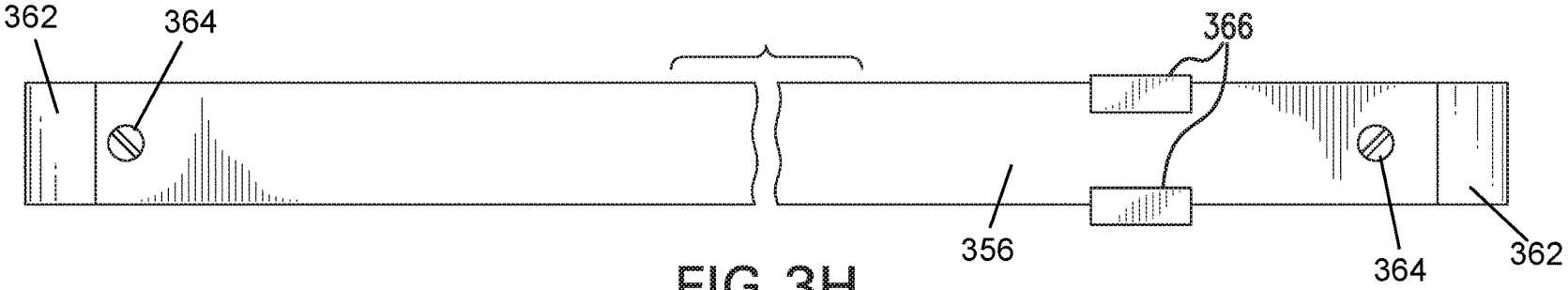
Figure 3K:
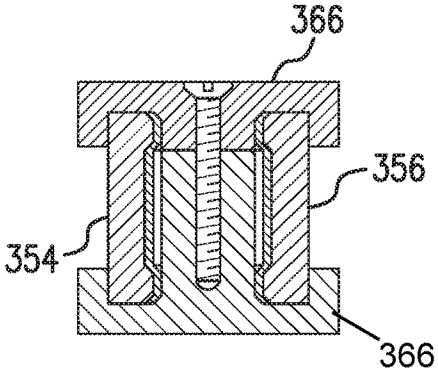
Figure 3J:
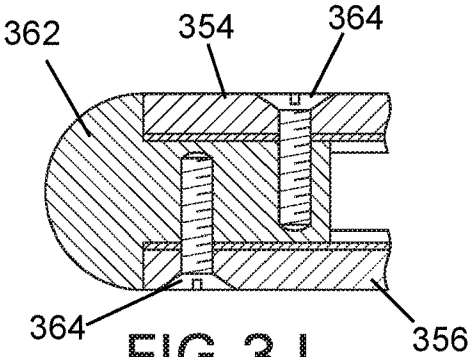
Figure 3I:
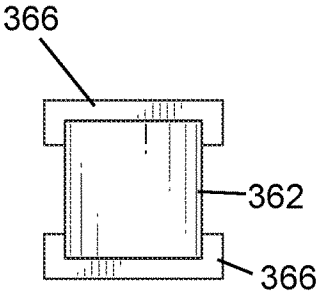

Preferably, the rails 354, 356 each have inner surfaces that are spaced at a nominal distance throughout the length of the power bar 300. The power bar 300 is made in standard lengths ranging from 12 to 48 inches. As shown in FIGS. 3H and 3K, for very long power bars, for example power bars exceeding twenty-four inches, a spacer 366 is placed between the rails 354, 356. The spacer 366 may be held in place by screws or other means.

FIGS. 4A-4G show details of a parallel bar hanger such as the hanger 206 supporting one power bar 304 from another power bar 302 in FIG. 1. The hanger 206 includes two vertical segments 230A, 230B. Both the top and the bottom ends of the two segments 230A, 230B are imbedded in identical W-shaped bases 232, shown in more detail in FIGS. 4B-4G.

The base 232 forms two channels 234, 236 with a wall 232C separating the two channels 234, 236. Two metallic springs or clips 240, 242 extend outwardly from the base 232 into the channels 234, 236, respectively. One of the clips 240 is electrically attached to one of the segments 230A within the base 232, and the other clip 242 is connected to the other of the segments 230B. Preferably, the base 232 is made of a non-conductive material and is overmolded to cover portions of the clips 240, 242 and the segments 230A, 230B. In one embodiment, both of the bases 232 between which the segments 230A, 230B extend, have a single, unitary structure. In another embodiment, at least one of the bases 232 is made of two sections 232A, 232B that snap together to form forming an interference fit therebetween.

Figure 4A:
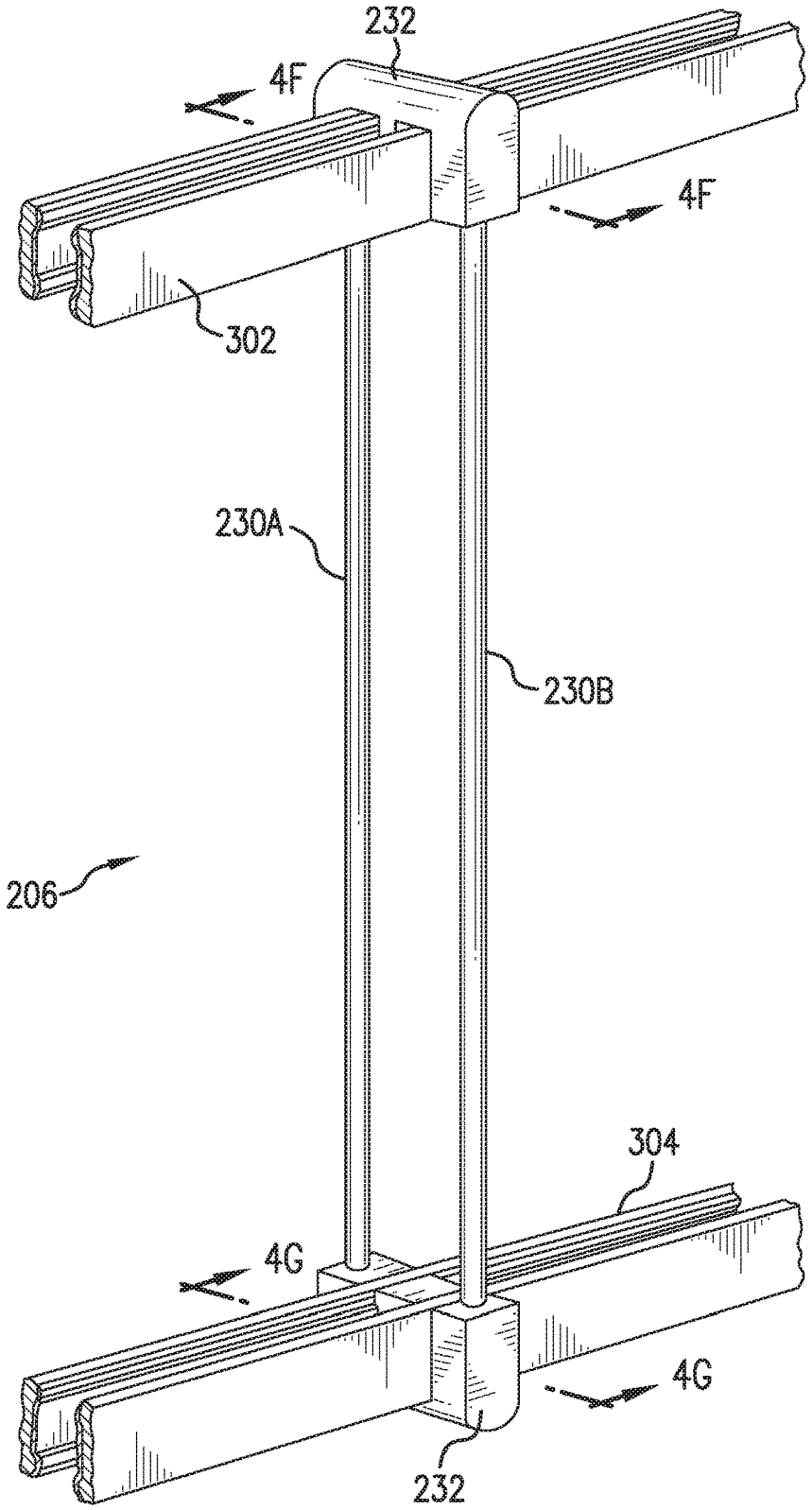
FIGS. 4A-4I are various views showing features of hangers used in the modular lighting system of FIG. 1 or FIG. 2.
Figure 4C:
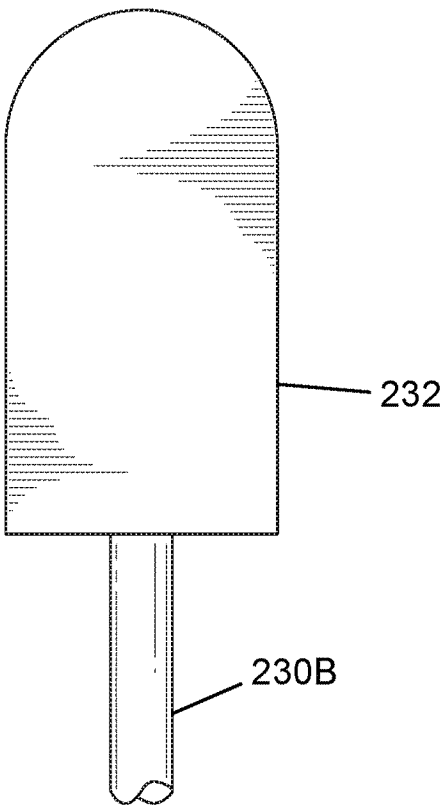
Figure 4B:
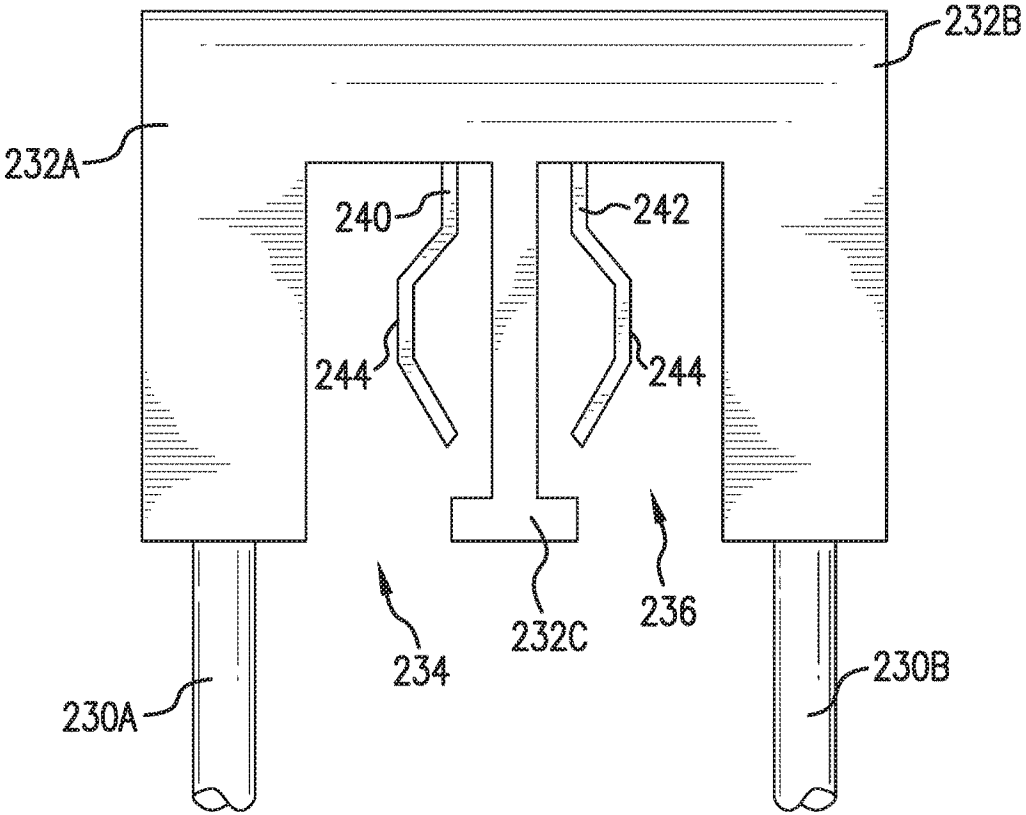
Figure 4D:
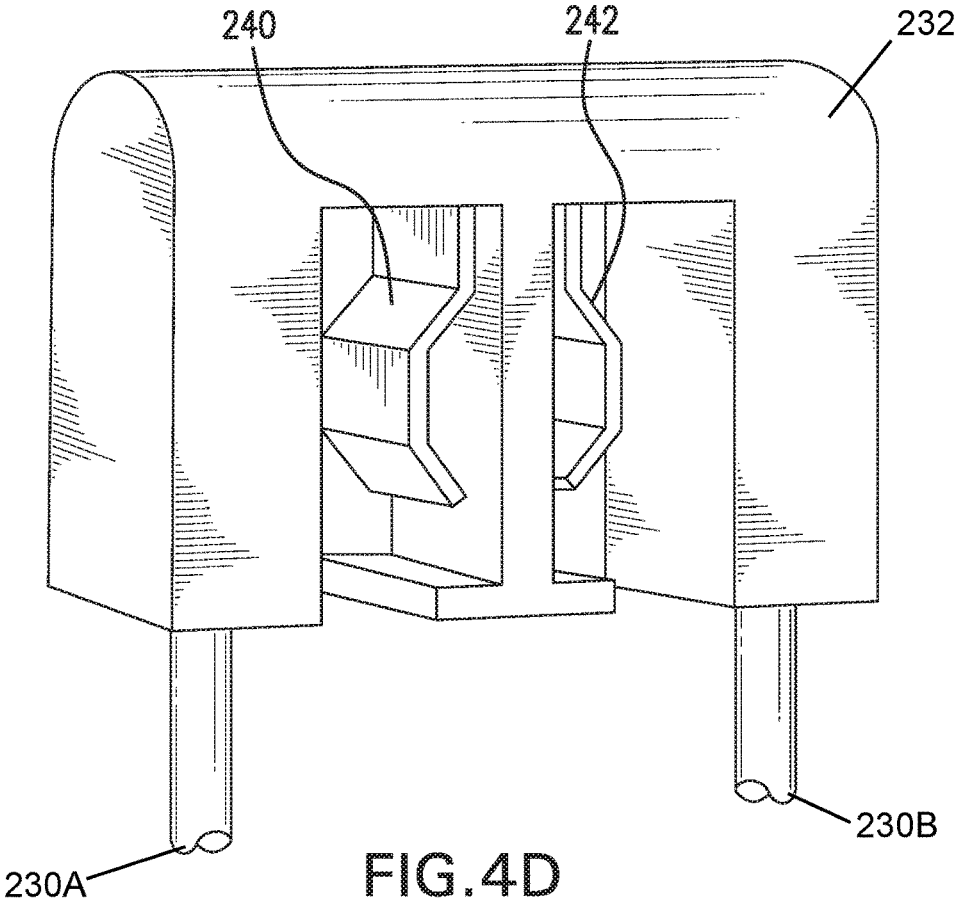
Figure 4E:
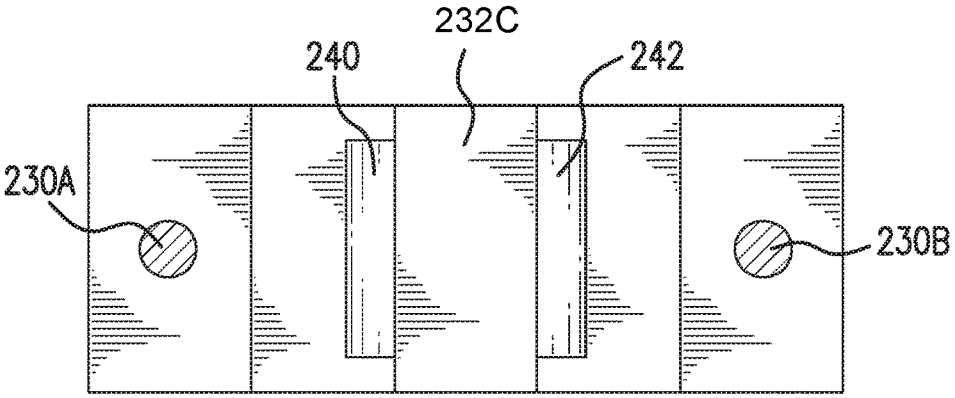
Figure 4F:
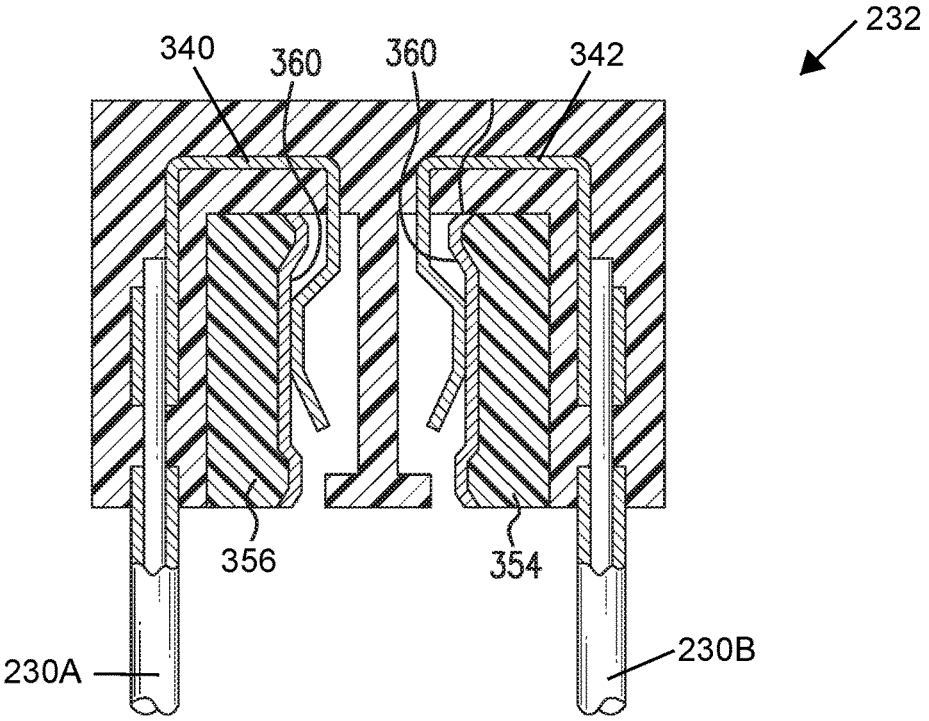
Figure 4G:
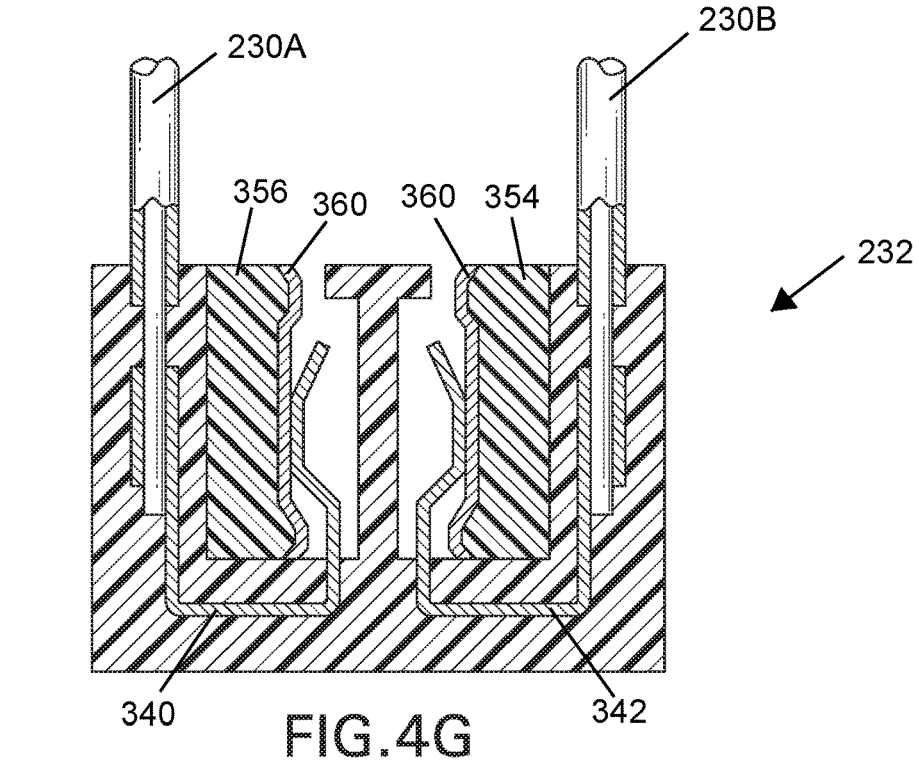
Figure 4H:
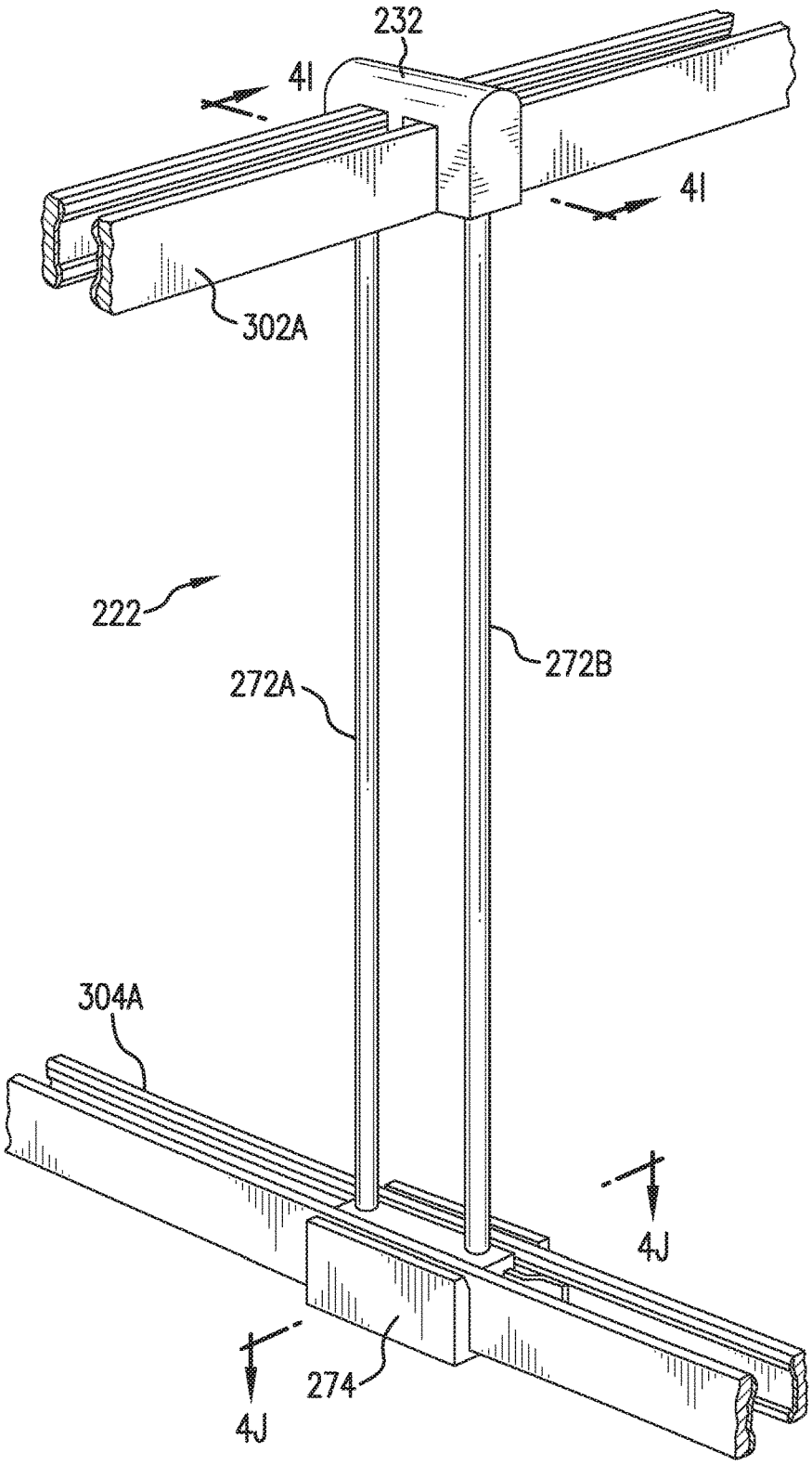

As can be seen in FIGS. 4F and 4G, the bases 232 are sized and shaped so that they fit over and engage the first power bar 302 and the second power bar 304. Importantly, the clips 240, 242 are sized and shaped so that they engage the rails 354, 356. The clips 240, 242 have flat sections 244 (see FIG. 4B) sized and shaped to snap into the rails 354, 356 of the first power bar 302 and the second power bar 304. In this manner, not only do the clips 240, 242 provide a solid electrical contact between flat sections 244 and the rails 354, 356, but they also stabilize the hangers on the bars and ensure that the lower bar 304 remains stiff and does move around in use. The clips 240, 242 may be made from beryllium copper.

The hanger 208 has a similar configuration, however, the clips 240, 242 need not be connected electrically to the hanger segments. For example, in the configuration shown in FIG. 2, hangers 222 do provide electrical connection to the second and third power bars 304A and 306A.

The hanger segments 230A, 230B are provided in various lengths as required to obtain the various systems described above, and they are preferably in the shape of rods made of a stiff but somewhat springy material having shape memory alloys such as a phosphor/bronze alloy. Preferably, except where an electrical contact is required, the rods are covered or painted with a thin electrically insulating material.

The hangers can be installed by separating the two segments 230A, 230B, passing the ends of the first power bar 302 and the second power bar 304 between the segments 230A, 230B, then lowering or raising the power bars 302, 304 toward the respective bases 232 and then snapping the bases 232 onto the power bars 302, 304 into the configurations shown in FIGS. 4F and 4G.

Figure 4I:
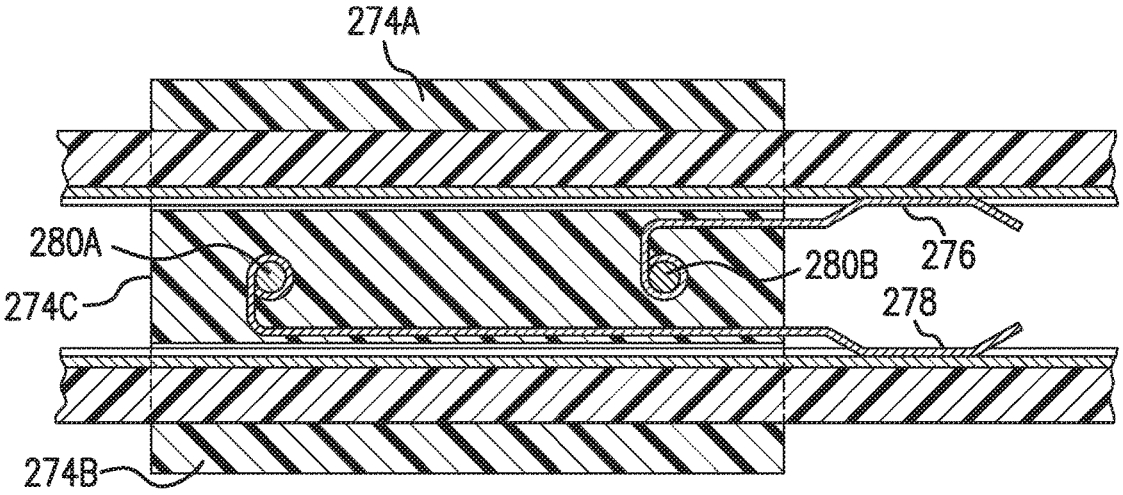
Figure 5A:
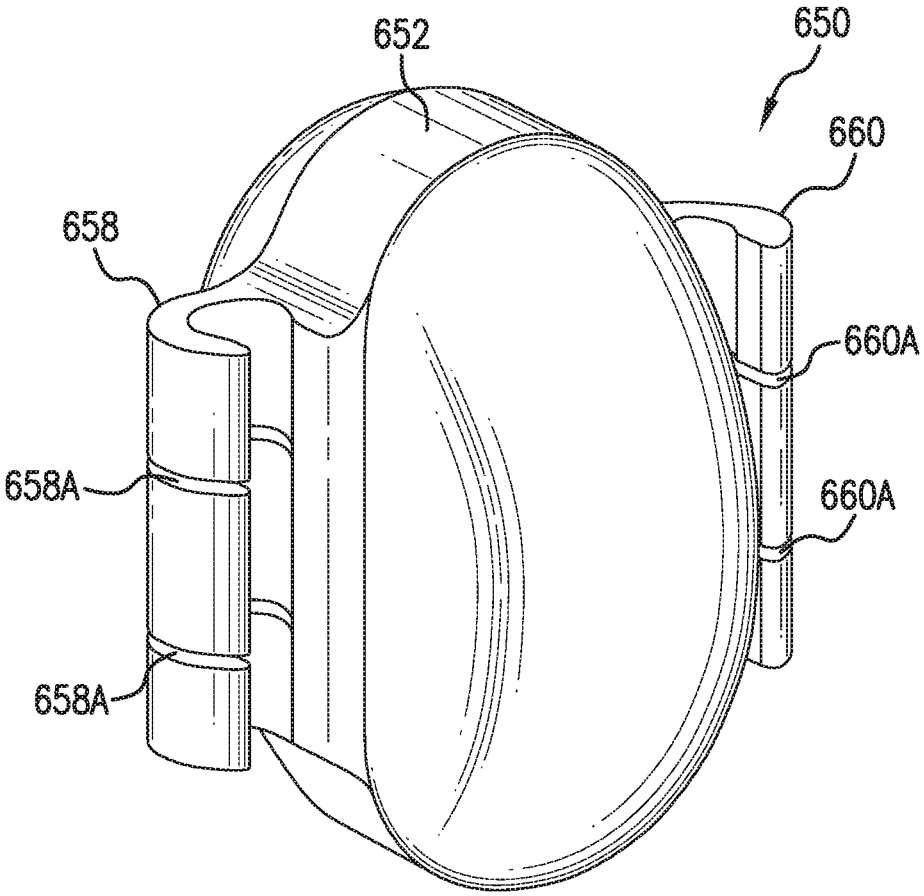
FIG. 5A is a perspective view of a pendant or light that can be used in the modular lighting system of FIG. 1 or 2.
Figure 5B:
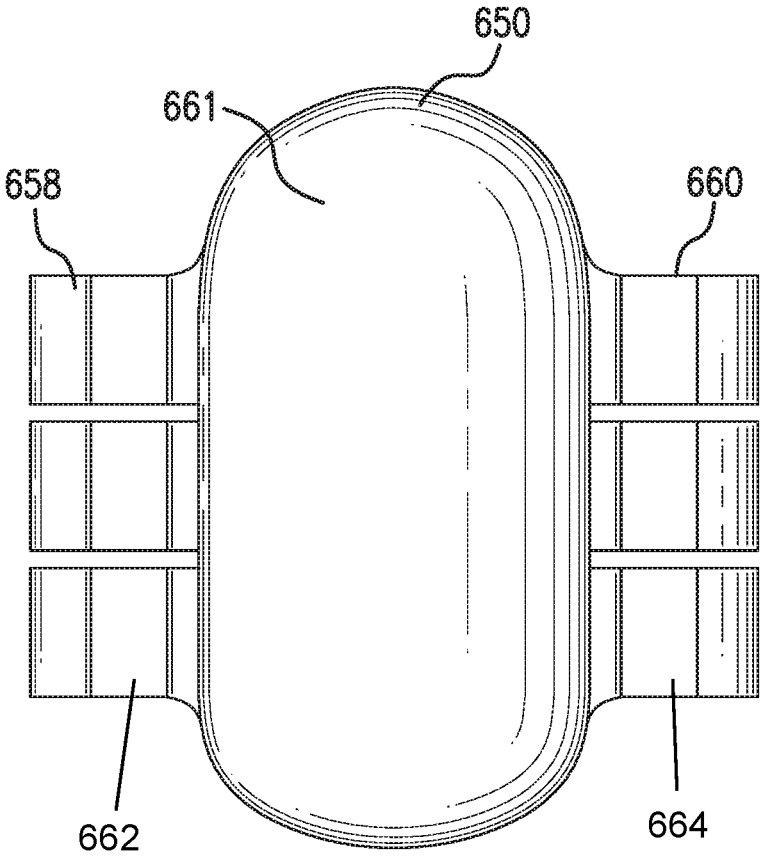
FIG. 5B is a front view of the light of FIG. 5A.
Figure 5C:
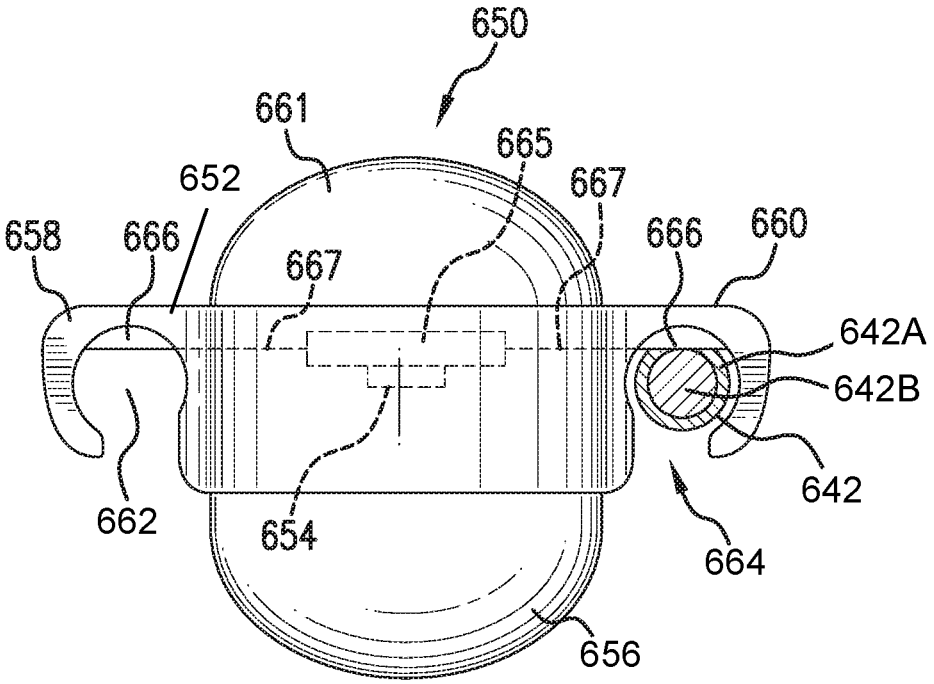
FIG. 5C is a top view of the light of FIG. 5A.
Figure 5D:
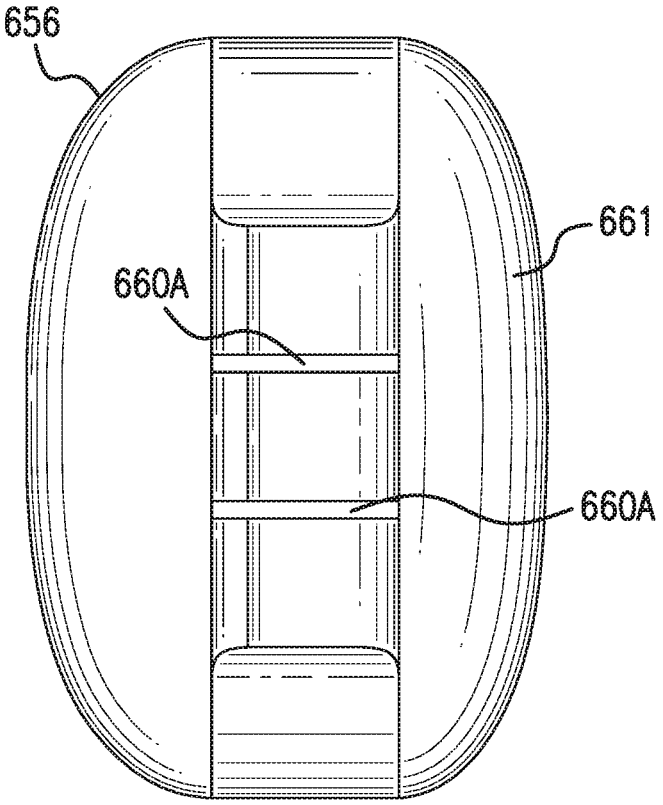
FIG. 5D is a side view of the light of FIG. 5A.

As discussed above, and illustrated in more detail below, in some instances, the power bars extend perpendicularly to each other. For example, in FIG. 2, the first power bar 302A and the second power bar 304A are perpendicular to each other. These bars are interconnected using a hanger 222 shown in FIG. 4H. The hanger 222 has two hanger segments 272A, 272B and a base 232 at the top similar to the base 232 in FIGS. 4A-4G. However, at the bottom, the hanger 222 has a different base 274 as shown in FIG. 4I. The base 274 is formed with two side wings 274A, 274B and a center wall 274C as shown in FIG. 4I. Clips 276, 278 are provided on the center wall 274C and are connected electrically with segments 272A, 272B, respectively as shown in FIG. 4I. The center wall 274C is made with two holes 280A, 280B with the lower ends of the hanger segments 272A, 272B extending into the holes and being secured to the base 204. The base 274 is sized and shaped to engage and support the first power bar 304A with the hanger segments 272A, 272B providing power to the first power bar 304A. The base 232 supports the first power bar 302 and provides the similar structure as discussed above and shown in FIGS. 4B-4G.

Figure 6C:
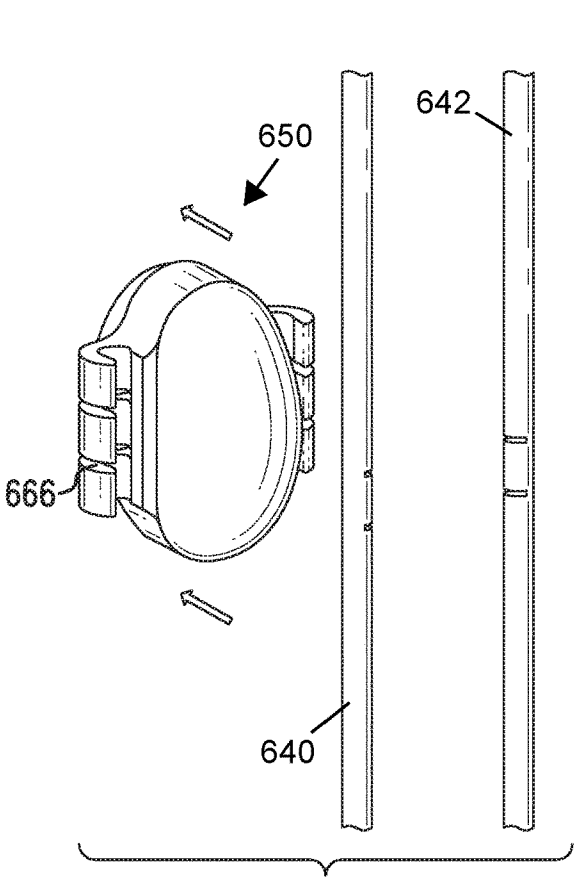
FIGS. 6A-6C are views of the light of FIG. 5A selectively mounted on and dismounted from a pendant hanger.
Figure 6B:
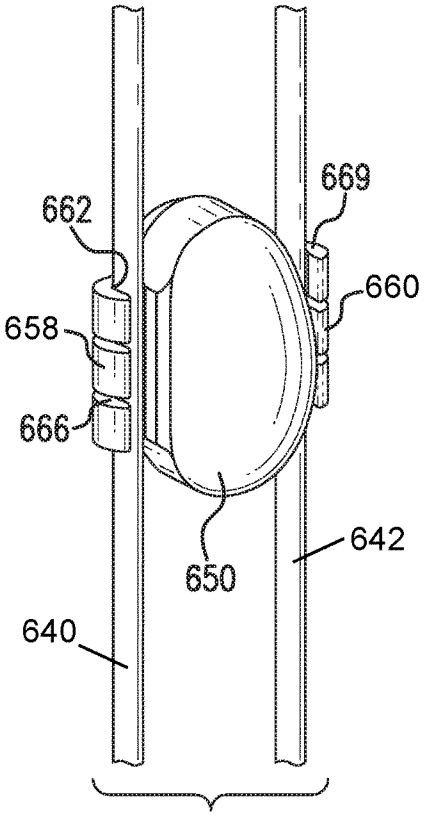
Figure 6A:
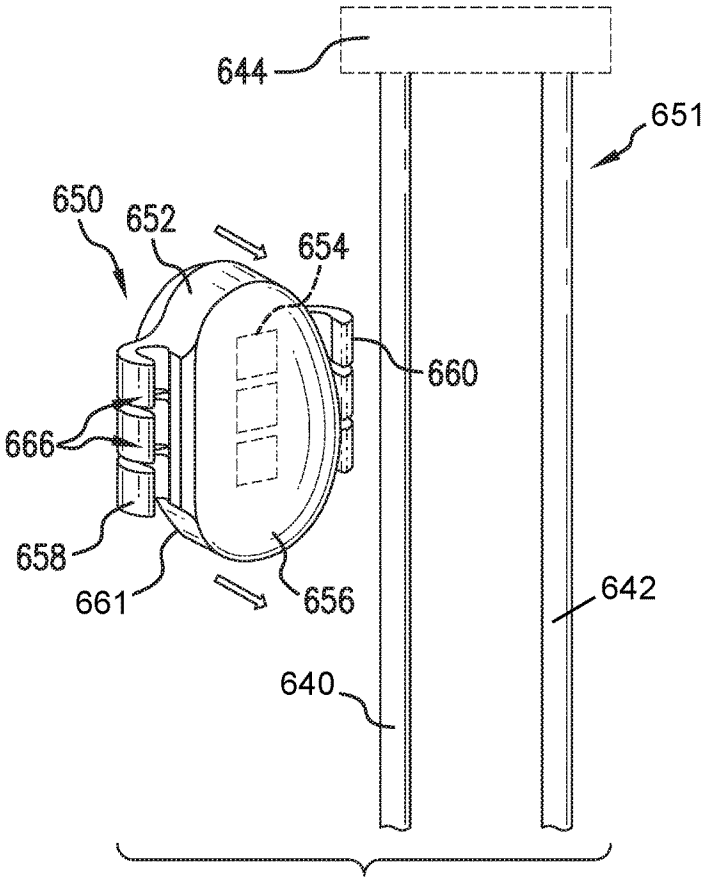

FIGS. 5A-5D show details of a pendant or light 650 that is configured to be laterally supported along its two sides by rods 640, 642 of a hanger 651. The hanger 651 can be included as a substitute or in addition to the hangers of the embodiments of FIGS. 1 and 2. The pendant 650 includes a body 652 holding one or more LEDs or other types of light sources 654 (FIG. 6H). The light sources 654 are disposed behind a transparent or translucent lens or diffuser 656 (FIG. 6F). The back 661 of the light 650 can be blank or the light 650 can include a second set of light sources similar to the light sources 654 that are covered by a lens or diffuser.

The body 652 includes two wings 658, 660 that are made of a resilient material and that each includes a longitudinal cavity 662, 664, respectively. The cavities 662, 664 have cross-sectional dimensions that are equal to or slightly smaller than rods 640, 642 of the pendant 650 so that the wings 658, 660 of the body 652 can be snapped onto the rods 640, 642 and form an interference fit with the respective rods 640, 642.

Importantly, each wing 658, 660 is formed with one or more transversal or horizontal cutouts 658A, 660A. These cutouts are used to house horizontal knives 666. The knives 666 are made of a metallic material, such as steel or copper and are arranged so that when the pendant 650 is snapped on the rods 640, 642, the knives 666 make a strong contact with the conducting portions of the rods 640, 642, thereby providing energy to the light sources 654.

FIGS. 6A-6H show details of the pendant 650 that is mounted between and supported by two rods 640, 642 that extend downwardly from a base 644 of the hanger.

Figure 6E:
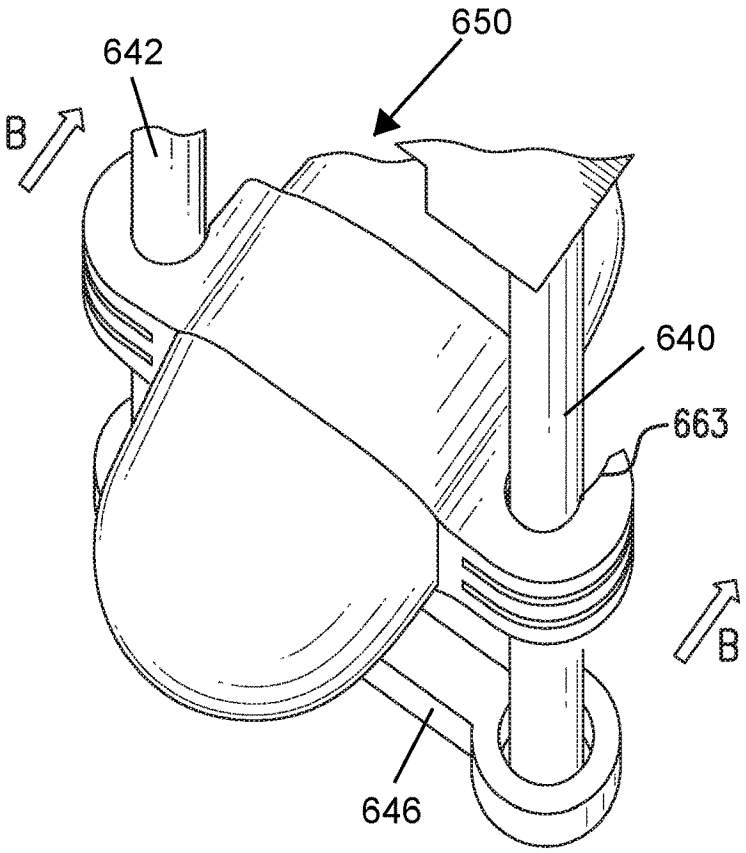
FIGS. 6D-6E are rear prospective views of the light of FIG. 5A selectively mounted on a pendant hanger.
Figure 6D:
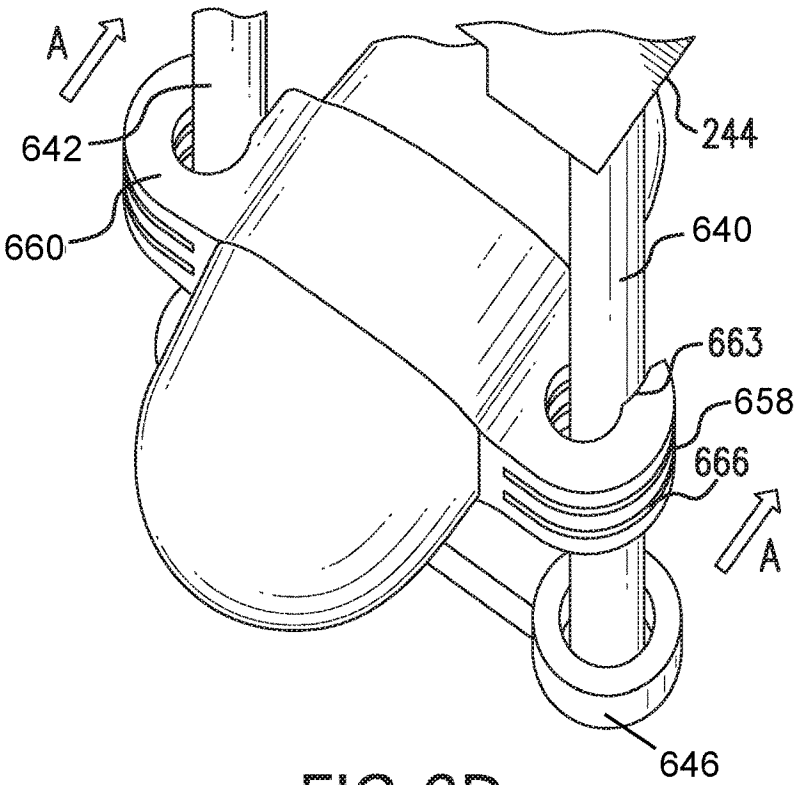
Figure 6H:
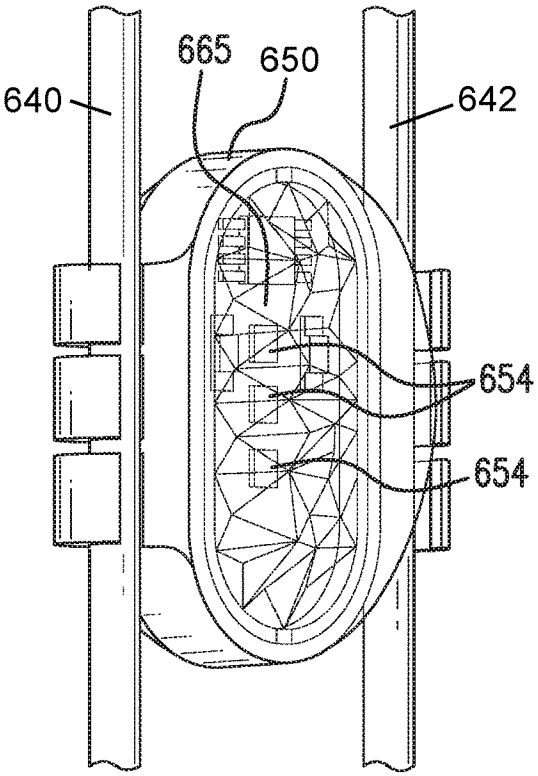
FIG. 6H is a perspective view of the light of FIG. 5A with lens/diffuser of FIG. 6F removed.

In one embodiment, the wings 658, 660 are shaped to enable the pendant 650 to be installed in two steps as illustrated in FIGS. 6D and 6E. In the first step, the pendant 650 is pushed forward in a direction A (see FIG. 6D) until a first detent formed by curved surfaces 663 on the inner sidewalls of each wing 658, 660 grabs the respective rod 640, 642. In a second step, the pendant 650 is pushed further in the direction B until the rods 640, 642 are secured within the wings 658, 660. Typically, the rods 640, 642 are covered with a thin layer of an insulating material or paint (not shown). As the pendant 650 is pushed in further to the position shown in FIG. 6E, the knives 666 cut through the insulating layer or paint on the rods 640, 642 to make respective electrical contacts with the conducting portions of the rods 640, 642. Knives 666 are connected to internal wiring 667 that connects to a printed circuit board 665 providing power to the light sources 654 (See FIGS. 5C and 6H). As shown in FIG. 6B, when the light 650 is fully mounted on the rods 640, 642 (in FIG. 5C rod 640 has been omitted for the sake of clarity), the knives 666 cut or pierce the insulation or coating 642A on rod 642 until they make mechanical and electrical contact with the core 642B of rod 642. The cores of the rods 640, 642 are connected to power sources and current from the rods 640, 642 are provided through wires 667 to the circuit board 665 and light sources 654.

Figure 6G:
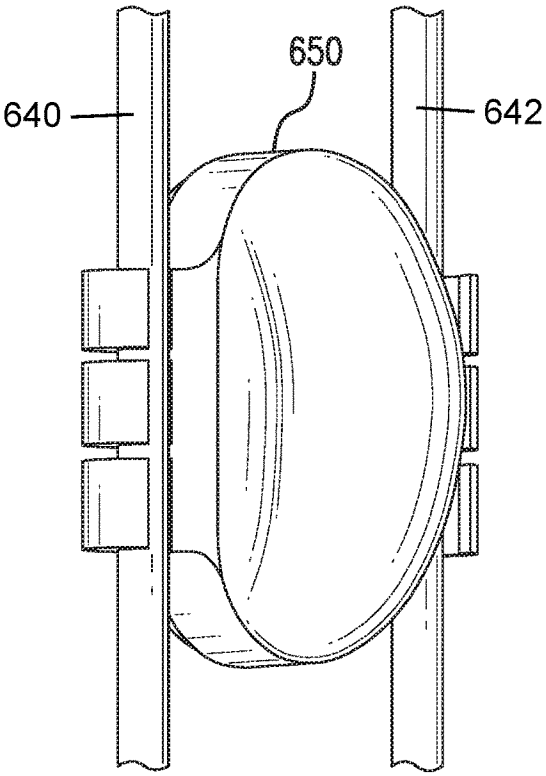
FIG. 6G is a perspective view of the lens/diffuser disposed on the light of FIG. 5A.
Figure 6F:
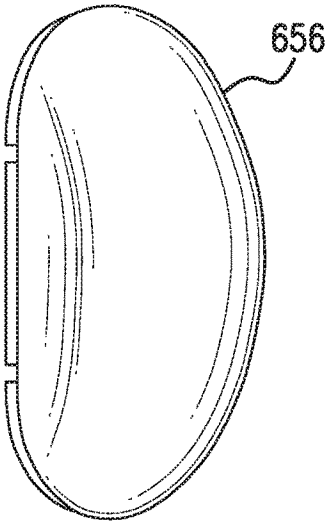
FIG. 6F is a perspective view of a lens/diffuser of the light of FIG. 5A.

FIG. 6F shows details of the cover 656 and FIGS. 6G and 6H show the details of the pendant 650 with and without the cover 656. As discussed above, the cover 656 (and optionally the back 661) can be made of a transparent or translucent material to act as a lens or diffuser for the light generated by the light sources 654.

Preferably, as noted above, one or more of the lights 650 are incorporated or mounted on a modular light system, such as the ones shown in FIGS. 1 and 2. As such, although FIGS. 5A-6J make reference to rods 640, 642 of a hanger 651, the hangers, associated rods and other components of the modular lighting systems of FIGS. 1 and 2 or similar systems can be configured or substituted with the hanger 651 to support the lights 650. Thus, the hanger 651 used to support the lights 650 can be used to support other pendants (e.g., 402, 404, 406, 408, 410) and/or power bars as well. It should be appreciated that the rods 640, 642 can be made of any desired lengths and that one or more lights 650 can be arranged on the rods 640, 642 at any distance from a base in which the rods 640, 642 are disposed. Moreover, while rods 640, 642 are shown as disposed vertically in a base, they could be disposed at an angle with respect to a vertical plane or disposed horizontally.

Figure 6I:
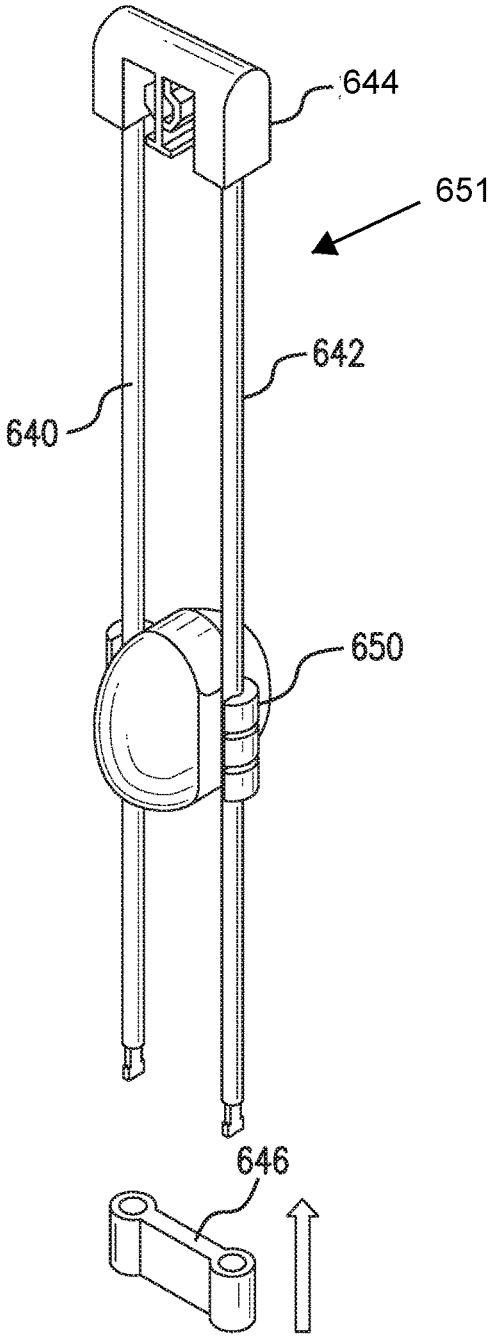
FIG. 6I is an assembly view of a hanger holding the light of FIG. 5A with an endcap being installed on the hanger.
Figure 6J:
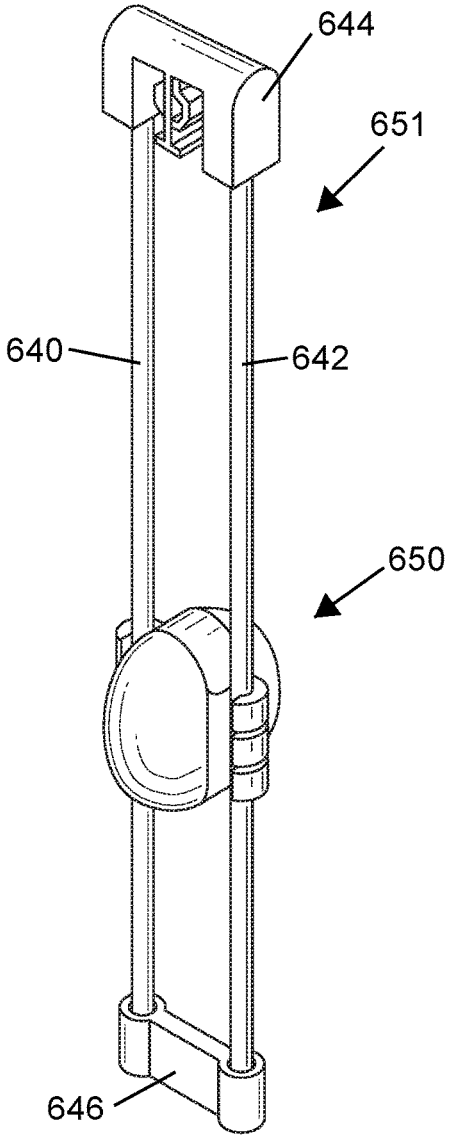
FIG. 6J is a perspective view of the hanger, light and endcap of FIG. 6I in an assembled state.

Alternatively, as shown in FIGS. 6I and 6J an end cap 646 may be provided to terminate the ends of the rods 640, 642, to hold them at a predetermined spacing and to protect them. End cap 646 is preferably made of a non-conducting material.

Numerous modifications may be made to this invention without departing from its scope as defined in the appended claims.

What is claimed is:

1. A light configured to be mountable on a hanger of a modular lighting system that includes two parallel rods that are covered with a protective layer, the light comprising:

a body having at least one surface supporting a light source; and a first wing and a second wing that extend directly from the body, the first wing including a first cavity that extends along a first axis and at least one first projection that extends transverse to the first axis and into the first cavity and the second wing including a second cavity that extends along a second axis that is different from the first axis and at least one second projection that extends transverse to the second axis and into the second cavity, the first cavity and the second cavity each sized and shaped for selective attachment to a respective one of the rods such that when one of the rods is arranged in the first cavity of the first wing, the at least one first projection is configured to at least one of pierce and cut the protective layer of material of the one of the rods so as to make electrical contact with a conduit in the one of the rods and when the other one of the rods is arranged in the second cavity of the second wing, the at least one second projection is configured to at least one of pierce and cut the protective layer of material of the other one of the rods so as to make electrical contact with a conduit in the other one of the rods.

2. The light of claim 1, wherein said light source is powered by current passing through the rods.

3. The light of claim 1, wherein said first wing and said second wing are configured to provide an electrical connection between said light source and said rods.

4. The light source of claim 1, further comprising a cover made of light transmissive material extending over said light source.

5. The light of claim 1, wherein said body has two opposed surfaces and each of said surfaces includes a light source disposed thereon.

6. The light of claim 1, wherein said wing and said second wing are shaped and configured to form interference fits with the rods.

7. The light of claim 6, wherein the at least one first projection and the at least one second projection are knives.

8. The light source of claim 1, wherein the first wing includes at least one cutout extending transverse to the first axis and the second wing includes at least one cutout extending transverse to the second axis, and the at least one first projection is arranged in the at least one cutout of the first wing and the at least one second projection is arranged in the at least one cutout of the second wing.

9. The light source of claim 1, wherein the first wing includes a plurality of projections and a plurality of cutouts extending transverse to the first axis in which the plurality of projections are arranged and second wing includes a plurality of projections and a plurality of cutouts extending transverse to the second axis in which the plurality of projections are arranged.

10. The light source of claim 1, wherein the first cavity of the first wing includes a first detent extending from an inner surface thereof and the second cavity of the second wing includes a second detent extending from an inner surface thereof.

11. The light source of claim 1, wherein the body, the first wing and the second wing are a single, one-piece element.

12. A light configured to be selectively mountable on a first rod and a second rod, which each includes a rod core covered by a layer of insulation, of a modular lighting system, said light comprising:

a body having at least one surface with a light source disposed thereon;

a cover disposed over said light source, said cover being made of a light transmissive material to allow light from the light source to project through the cover; and a first wing and a second wing attached to and extending directly from said body such that the body, the first wing and the second wing are a one-piece element, the first wing includes a first cavity that extends along a first axis and at least one first projection that extends transverse to the first axis and into the first cavity and the second wing includes a second cavity that extends along a second axis that is different from the first axis and at least one second projection that extends transverse to the second axis and into the second cavity with each of said first wing and said second wing configured to selectively engage one of said rods to support said body on said rods, said first wing and said second wing further being adapted to pierce the layer of insulation on the rods when said rods contact said first projection and second projection and provide electrical connection from the rod cores to the light source.

13. The light source of claim 12, wherein the at least one first projection is a first knife and the at least one second projection is a second knife.

14. The light source of claim 12, wherein said body includes two surfaces and light sources disposed on said surfaces.

15. The light source of claim 12, wherein the rods extend vertically in parallel to each other and the body is attached at any point along a length of the rods.

16. The light source of claim 12, wherein the first wing includes at least one cutout extending transverse to the first axis and the second wing includes at least one cutout extending transverse to the second axis, and the at least one first projection is arranged in the at least one cutout of the first wing and the at least one second projection is arranged in the at least one cutout of the second wing.

17. The light source of claim 12, wherein the first wing includes a plurality of projections and a plurality of cutouts extending transverse to the first axis in which the plurality of projections are arranged and second wing includes a plurality of projections and a plurality of cutouts extending transverse to the second axis in which the plurality of projections are arranged.

18. The light source of claim 12, wherein the first cavity of the first wing includes a first detent extending from an inner surface thereof and the second cavity of the second wing includes a second detent extending from an inner surface thereof.

* * * * *